United States Patent [19]

Nonomura et al.

[11] 4,404,493

[45] Sep. 13, 1983

[54] PICTURE IMAGE DISPLAY APPARATUS

[75] Inventors: Kinzo Nonomura, Hirakata; Masanori Watanabe, Katano; Yoshinobu Takesako, Neyagawa; Hiroyuki Irie, Osaka; Susumu Ide, Katano, all of Japan

[73] Assignee: Matsushita Electric Industrial Co., Ltd., Kadoma, Japan

[21] Appl. No.: 250,713

[22] Filed: Apr. 3, 1981

[51] Int. Cl.[3] ..... H01J 29/70

[52] U.S. Cl. ..... 313/422; 313/413; 313/427

[58] Field of Search ..... 313/422, 413, 427; 315/366

[56] References Cited

U.S. PATENT DOCUMENTS 2,972,719 2/1961 Michlin ..... 313/422 X
3,935,500 1/1976 Oess ..... 313/495
4,227,117 10/1980 Masanori et al. ..... 313/422 X

FOREIGN PATENT DOCUMENTS 55-33734 3/1980 Japan .

OTHER PUBLICATIONS

"The Physical Mechanisms of Feedback Multiplier Electron Sources", Carmen A. Catanese & John G. Endriz, *SID Digest*, 1978, pp. 122–127.

*Primary Examiner*—Eugene R. LaRoche
*Attorney, Agent, or Firm*—Cushman, Darby & Cushman

[57] ABSTRACT

The picture image display apparatus in accordance with the present invention comprises:

a flat type vacuum enclosure having a transparent face panel, an electron beam emitter which emits a predetermined number of electron beams disposed in a row in selected positions, a row of control electrodes to control intensities of said electron beams, a row of parallel deflection electrodes, every other one of them being first electrodes commonly connected each other, the other ones of them being second electrodes commonly connected to each other, a phosphor screen formed on the inner face of said face panel and, an anode of thin metal film formed on said surface of said phosphor screen, wherein the apparatus is characterized in that every gap defined by one of said first electrodes and one of said second electrode neighboring thereto form deflection electric fields of opposite directions to each other, and said gaps are disposed in a manner that said electron beams simultaneously pass through every said deflection gap.

4 Claims, 17 Drawing Figures

PICTURE IMAGE DISPLAY APPARATUS

BACKGROUND OF THE INVENTION

1. Field of the Invention

The present invention relates to an improvement of a multiple electron beam type picture image display apparatus and especially concerns the picture image display apparatus having a novel structure enabling easy manufacture and high quality picture display.

2. Description of the Prior Art

Several proposals have been made on multiple electron beam type flat shaped picture display device, for example in the U.S. Pat. No. 3,935,500 (to Oess et al.) and SID 78 Digest pp. 122 to 127. Furthermore, three of the inventors of the present invention have invented and proposed a multiple electron beam type picture display apparatus described in the specification of the Japanese Patent Application Sho 53-106788 filed on Aug. 30, 1978 (published as unexamined patent gazette Sho 55-33734 on Mar. 10, 1980) and also described in the specification of the U.S. Pat. No. 4,227,117 (to Watanabe et al.) patented on Oct. 7, 1980.

The structure of picture image display apparatus of the abovementioned described invention is shown in FIG. 1(*a*) which is an exploded view of the principal part of the apparatus. The apparatus comprises, as shown from the upper part to the lower part in FIG. 1(*a*), and FIG. 1(*b*), an isolation electrode 2 having a plural number of isolation walls 201 to define oblong isolated spaces 202, a row of predetermined number M (e.g. M=48) of linear thermionic cathodes 1 disposed in parallel (i.e., line cathodes, each of which comprises a linear filament line to be heated by a low voltage, e.g., D.C. 10 V and electron emissive oxide coating thereon, and hereinafter is referred to as linear thermionic cathode) each being disposed in the isolated spaces 202, an extractor being disposed in the isolated spaces 202, an extractor electrode 3 having a predetermined number N (e.g. N=107) of electron beam passing apertures 3*a* disposed in rows under the linear thermionic cathodes 1, a row of control electrodes 4 for controlling beam intensity disposed parallelly in parallel in a direction perpendicular to those of said linear thermionic cathodes 1 each having electron beam passing openings 4*a* under the apertures 3*a*, an electron beam forming electrode 5 having electron beam passing openings 5*a* under the openings 4*a*, a row of vertical deflection electrodes comprising pairs of common-connected first electrodes 6 and common-connected second electrodes 6', a row of horizontal deflection electrodes comprising pairs of common-connected first electrodes 7 and common-connected second electrodes 7', an electric field shielding electrode 8, an anode 9 of vapor-deposited thin aluminum film, and a phosphor screen 10 formed on a face panel 11 of a vacuum enclosure. Every electron beam e, e . . . passes through deflection spaces 62, 62 . . . and 72, 72 . . . defined by the deflection electrodes pairs 6, 6', . . . and 7, 7', . . . disposed regularly in the same order with respect to every electron beam as shown in FIG. 1(*a*) and FIG. 1(*b*).

In the operation of such multiple electron beam type display apparatus described in the abovementioned specifications, scannings of beam spots on the phosphor screen are made in the known line-at-a-time type scanning, wherein ordinary time-sequential image signal is converted into a plural number of parallel signals. For example, by taking a case to display an image field raster having numbers of picture elements of 240 (in vertical direction) times 321 (in horizontal direction), with regard to the horizontal scanning of the beam spots the raster is divided into a plural number N of vertically oblong sections, wherein the horizontal scannings are carried out simultaneously in all of N sections. Then, each section has picture elements of n=(321/N) in the horizontal direction. For example, when the number N of the vertical sections is 107, the number n of picture element in each section is 3. For such example, 107 beam spots are produced from each linear thermionic cathode and 107 control electrodes are provided in order to control the 107 electron beam intensities. In the apparatus, the horizontal scanning is made by using saw-tooth wave having a horizontal scanning period H applied to the horizontal deflection electrode and in a manner that all the N beam spots are deflected simultaneously to scan in the same direction taking one horizontal scanning period H. The horizontal scanning period H is equal to the horizontal scanning period of the ordinary time sequential television signal. In order for attaining such line-at-a-time-scanning, the ordinary time sequential image signal is preliminarily converted into the N parallel signals of the line-at-a-time type.

The vertical scanning of the described apparatus is made by dividing the raster into a plural number M of horizontally oblong sections, and at first in the first section, for example in the uppermost section, the plural number of beam spots, which simultaneously scan, also scan vertically (downwards). When the vertical scanning in the first section is over and all the beam spots reach the bottoms of the first horizontally oblong sections, then the forming of electron beams from the electron from the first linear thermionic cathode ends and the forming of electron beams from the electrons from the second linear thermionic cathode starts, and the vertical scannings of the beam spots start in the second horizontally oblong section and scan downwards in the same way as in the first section. The vertical scanning is made thus downwards to the bottom or M-th section by applying a saw-tooth wave having a period (V/M), where V is the vertical scanning period of the ordinary television signal. For the abovementioned example of the raster having the number of vertical picture element of 240, when the number M of the horizontally oblong sections is 48, each of the section has the horizontal scanning lines of a number of m=(240/48)=5. That is to say, the example apparatus uses 48 linear thermionic cathodes, and each cathode vertically scans to produce 5 horizontal scanning lines.

FIG. 2 shows a block diagram of an example of the circuit for driving the abovementioned apparatus described in the abovementioned specifications. The circuit of FIG. 2 is constituted as follows. A video signal from the input terminal 12 is led to a video signal amplifier 13 and a synchronization signal separator 14, output of which is given to a sampling pulse generator 15 and a synchronization signal generator 19. A memory circuit 16 receives time sequential signal from the video amplifier 13 and sample-hold it in order for conversion it to the parallel type video signal by a multiplexer circuit 17. That is, the multiplexer circuit 17 takes out memorized video signal from the memory 16 and rearranges it into the N (=107) parallel signals, in each of which n (=3) data in the memory 16 are rearranged into time sequential signal to take the time period of H. The parallel outputs of the multiplexer circuit 17 are given through an amplifier 18 to the control electrodes of the display apparatus. Horizontal deflection signal generator 20 and vertical deflection signal generator 22 receive signal from the synchronization signal generator 19 and issue horizontal deflection signal and vertical deflection signal through the amplifiers 21 and 23 to the horizontal deflection electrodes and vertical deflection electrodes of the display apparatus, respectively. A cathode control circuit 24 receives signal from the synchronization signal generator 19 and issues control signal to the linear thermionic cathodes, in order that electron beams are selectively formed from the electrons from a selected linear thermionic cathodes in sequence by application of negative potential with respect to the electrode 3 thereto, thereby to scan for the period of $m \times H$.

FIG. 3 shows waveforms (A), (B), (C), (D), (E), (F) and (G) of various parts of FIG. 2 circuit for the example of $n=3$ and $m=5$. The waveforms (A) and (B) are those of horizontal synchronization signal and vertical synchronization signal, wherein H designates the time period of one horizontal scanning and V designates the time period of one vertical scanning of the ordinary television signal. The waveforms (C) and (D) are voltages to be applied to the first and the second linear thermionic cathodes, respectively for switchingly operating the cathode in sequence. The waveforms (E) and (F) are issued from the vertical deflection signal generator circuit 22 and horizontal deflection signal generator circuit 20, respectively, and the waveform (G) is the control signal to be applied to the control electrode 4 of the display apparatus. Accordingly, the scannings of the beam spots seen at enlarged parts of the phosphor screen is as shown in FIG. 11(*a*).

The structure of the apparatus of FIG. 1(*a*) has a large number of deflection electrodes, such as 107 common-connected first electrodes 7 and 107 common-connected second electrodes 7', that is 214 deflection electrodes forming a row in total. Therefore, the pitch of the deflection electrodes must be 1 to 2 mm, and hence the width of each one deflection electrode 7 or 7' must be 0.2 to 0.5 mm. Disposing such fine deflection electrode in parallel insulating each-other neighboring ones may make the manufacturing process very difficult, and furthermore such fine wires may make bending or sag during heating and cooling processes, or such fine electrodes likely to form uneven surfaces during etching process to make them. Accordingly, the picture image reproduced on such apparatus is liable to distortions of the deflection.

In order to avoid such disadvantage of the abovementioned very fine deflection electrodes, a use of wide deflection electrodes has been considered, but such wide deflection electrodes have disadvantages of larger deflection distortions and poor resolution. Such disadvantages are elucidated referring to FIG. 4(*a*) showing an example of deflections by the fine deflection electrodes of the apparatus of FIG. 1, and FIG. 4(*b*) showing an example of deflections by the wide deflection electrodes. As comparingly shown in FIGS. 4(*a*) and 4(*b*) by use of the wide deflection electrodes as in FIG. 4(*b*) the number of electrodes are largely reduced to less than half and such wide electrodes make the manufacturing easier. However, as shown by FIG. 4(*b*), the deflection angle becomes much larger in case of the wide deflection electrodes, and such wide angle deflection leads to distortions of deflection, and as shown by the chain lines in FIG. 4(*b*), the wide angle deflection is likely to induce spreading of the deflected electron beams and hence erroneous impingement on the neighboring phosphors, and may cause decrease of resolution or color saturation.

SUMMARY OF THE INVENTION

The present invention provides a novel improved picture image display apparatus capable of accurate horizontal scanning and enabling easy manufacturing.

BRIEF EXPLANATION OF THE DRAWINGS

FIG. 1(*b*) is a sectional view of the apparatus of FIG. 1(*a*).

FIG. 5(*b*) is a sectional view of the apparatus of FIG. 5(*a*).

FIG. 5(*c*) is an enlarged sectional view of a deflecting part of the apparatus of FIG. 5(*a*).

DESCRIPTION OF THE PREFERRED EMBODIMENTS

The picture image display apparatus in accordance with the present invention comprises:

- a flat type vacuum enclosure having a transparent face panel,
- an electron beam emitter which emits a predetermined number of electron beams disposed in a row in selected positions,
- a row of control electrodes to control intensities of said electron beams,
- a row of parallel deflection electrodes, every other one of them being first electrodes and common-connected to each other, and the other ones them being second electrodes and common-connected to each other,
- a phosphor screen formed on the inner face of said face panel,
- an anode of thin metal film formed on the surface of said phosphor screen, and the apparatus is characterized in that every gap defined by one of said first electrodes and one of said second electrodes neighboring thereto form deflection gaps, neighboring ones of said gaps having electric fields of opposite directions to each other, and said gaps are disposed in a manner that said electron beams simultaneously pass through every said deflection gaps.

Figure 5:
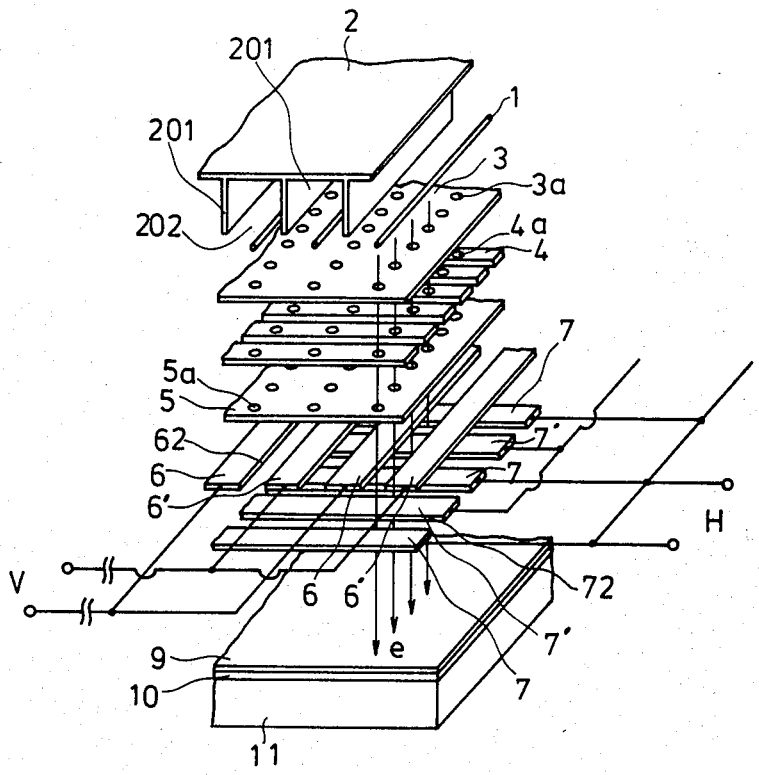
FIG. 5(*a*) is an exploded perspective view showing the principal part of a display apparatus embodying the present invention.
Figure 5:
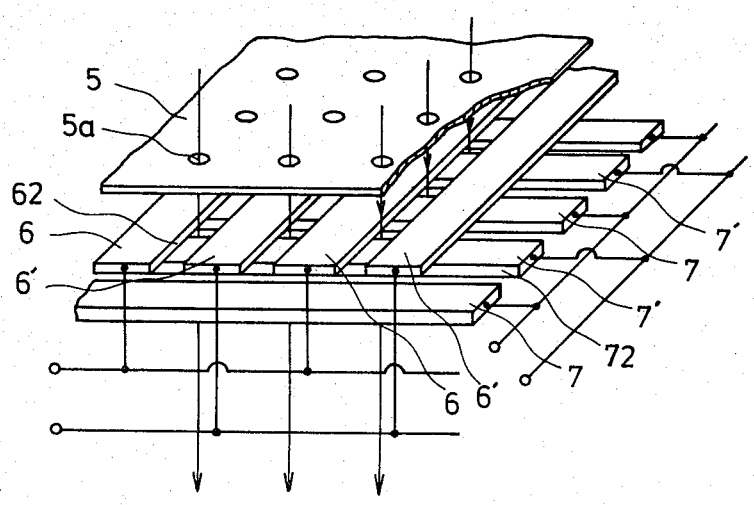
Figure 5:
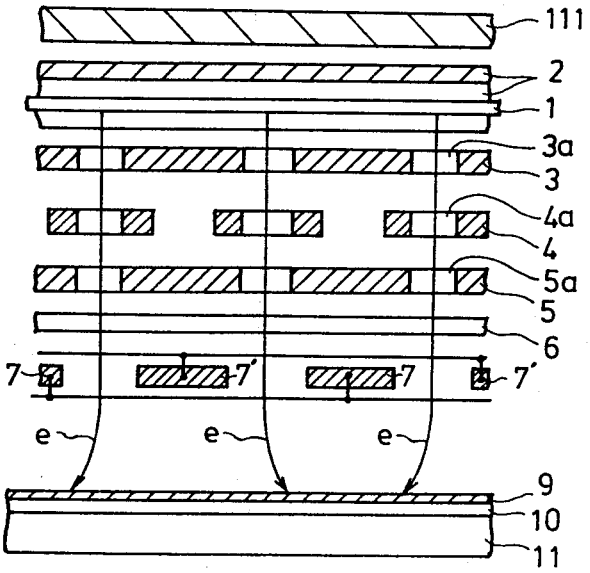

An example of the picture image display apparatus embodying the present invention is shown in FIG. 5(*a*) which is an exploded view of the principal part of the apparatus. The apparatus comprises, as shown from the upper part to the lower part in FIG. 5(*a*), and FIG. 5(*b*), an isolation electrode 2 having a plural number of isolation walls 201 to define oblong isolated spaces 202, a row of predetermined number M (e.g. M=48) of linear thermionic cathodes 1 disposed in parallel each being disposed in the isolated spaces 202, an extractor electrode 3 having a predetermined number N (e.g. N=107) of electron beam passing apertures 3*a* disposed under the linear thermionic cathodes 1, a row of control electrodes 4 for controlling beam intensity disposed parallell in a direction perpendicular to those of said linear thermionic cathodes 1 each having electron beam passing openings 4*a* under the apertures 3*a*, an electron beam forming electrode 5 having electron beam passing openings 5*a* under the openings 4*a*, a row of vertical deflection electrodes comprising pairs of comon-connected first electrodes 6 and common-connected second electrodes 6', a row of horizontal deflection electrodes comprising pairs of common-connected first electrodes 7 and common-connected second electrodes 7', an electric field shielding electrode 8, an anode 9 of vapor-deposited thin aluminum film, and a phosphor screen 10 formed on a face panel 11 of a vacuum enclosure. Every electron beam e, e . . . passes through deflection spaces 62, 62 . . . and 72, 72 . . . defined by the deflection electrodes pair 6, 6' . . . and 7, 7' . . . disposed regularly in the same order with respect to every electron beam as shown in FIG. 5(*a*) and FIG. 5(*b*).

FIG. 5(*c*) is an enlarged sectional view of a deflecting part of the apparatus of FIG. 5(*a*).

Figure 6:
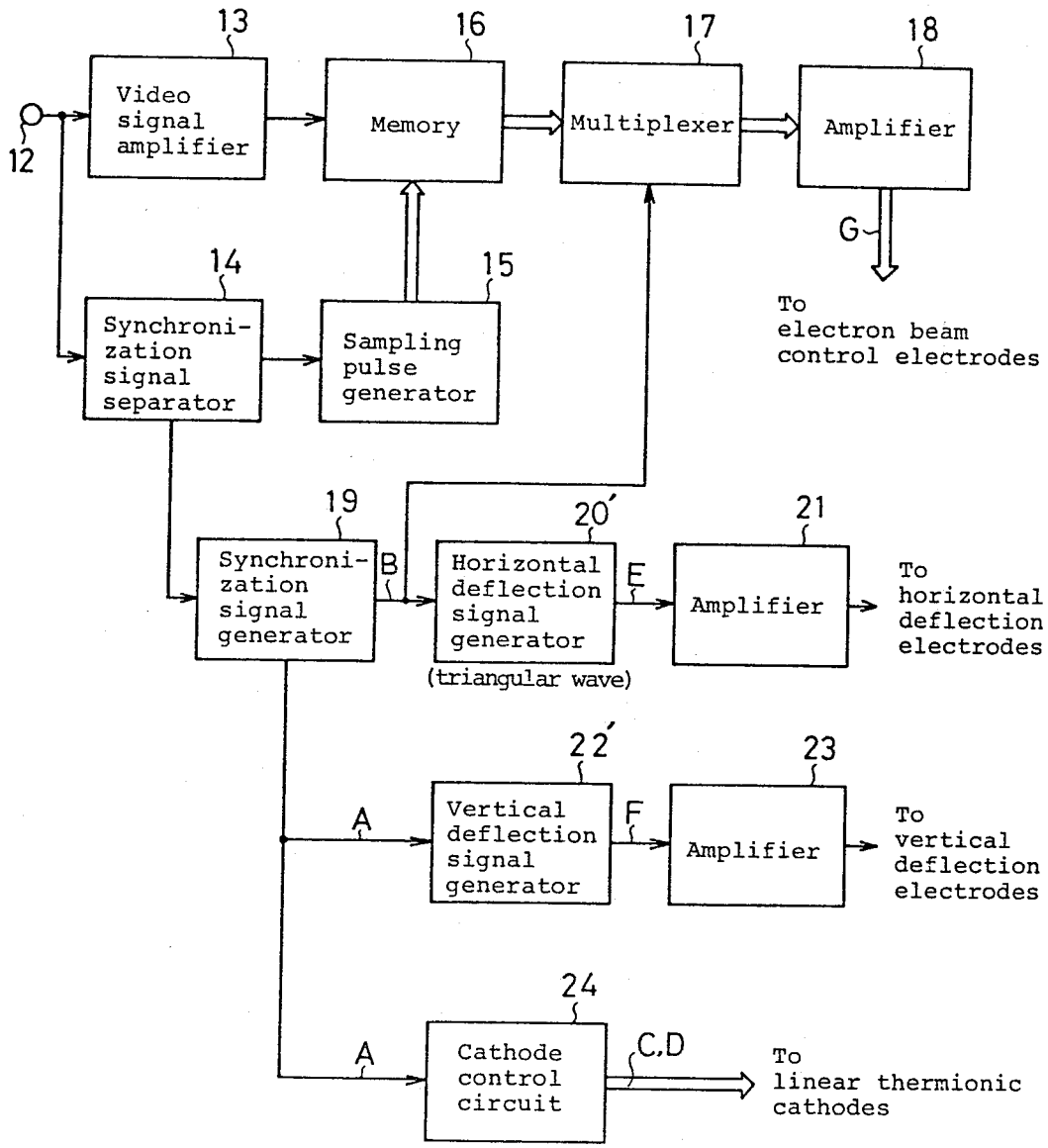
FIG. 6 is a circuit diagram of the apparatus embodying the present invention.

FIG. 6 shows a block diagram of an example of the circuit for driving the abovementioned apparatus of FIG. 5(*a*) and FIG. 5(*b*). The circuit of FIG. 6 is constituted as follows. A video signal from the input terminal 12 is led to a video signal amplifier 13 and a synchronization signal separator 14, output of which is given to a sampling pulse generator 15 and a synchronization signal generator 19. A memory circuit 16 receives time sequential signal from the video amplifier 13 and sample-hold it in order for conversion it to the parallel type video signal by a multiplexer circuit 17. That is, the multiplexer circuit 17 takes out memorized video signal from the memory 16 and rearranges it into the N (e.g. 107) parallel signals, in each of which n (e.g. 3) data in the memory 16 are rearranged into time sequential signal to take the time period of H. The parallel outputs of the multiplexer circuit 17 are given through an amplifier 18 to the control electrodes 4, 4', of the display apparatus of FIGS. 5(*a*) and 5(*b*). Horizontal deflection signal generator 20' and vertical deflection signal generator 22' receive signals from the synchronization signal generator 19 and issue horizontal deflection signal and vertical deflection signal through the amplifiers 21 and 23 to the horizontal deflection electrodes 7, 7' and vertical deflection electrodes 6, 6' of the display apparatus, respectively. A cathode control circuit 24 receives signal from the synchronization signal generator 19 and issues control signal to the linear thermionic cathodes 1, in order that electrons from selected one of the linear thermionic cathodes 1 selectively form electron beams for the period of m×H by application of a negative potential thereto, so as to allow scanning for the period of m×H, where m is the number of horizontal scannings made by each linear thermionic cathode, for example m=5.

Figure 7:
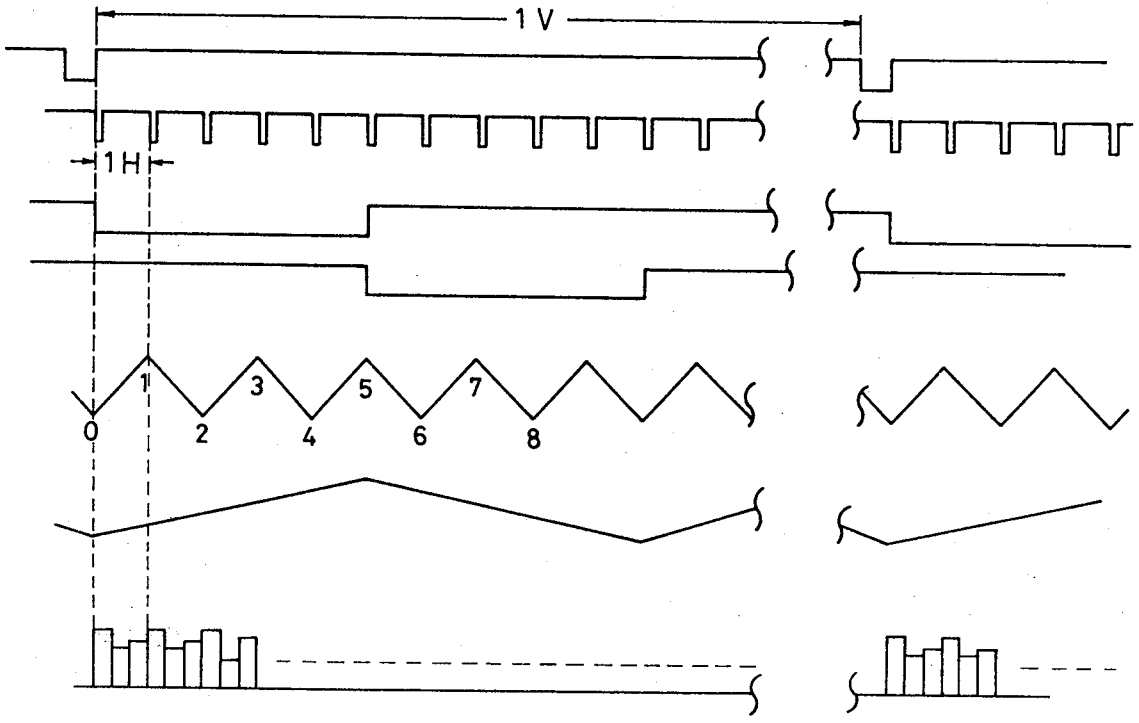
FIG. 7 is a waveform chart of signals of the example circuit.

FIG. 7 shows waveforms (A), (B), (C), (D), (E), (F) and (G) of various parts of FIG. 6 circuit for the example of n=3 and m=5. The waveforms (A) and (B) are those of horizontal synchronization signal and vertical synchronization signal, wherein H designate the time period of one horizontal scanning and V designate the time period of one vertical scanning. The waveforms and (C) and (D) are voltages to be applied to selected one and the others of the linear thermionic cathodes, respectively for switchingly operating the cathodes in sequence. The waveform (E) is issued from the horizontal deflection signal generator circuit 20', and the waveform (F) is issued from the vertical deflection signal generator circuit 22', respectively, and the waveform (G) is the control signal to be applied from the circuit 18 to the control electrodes 4 of the display apparatus.

Figure 8:
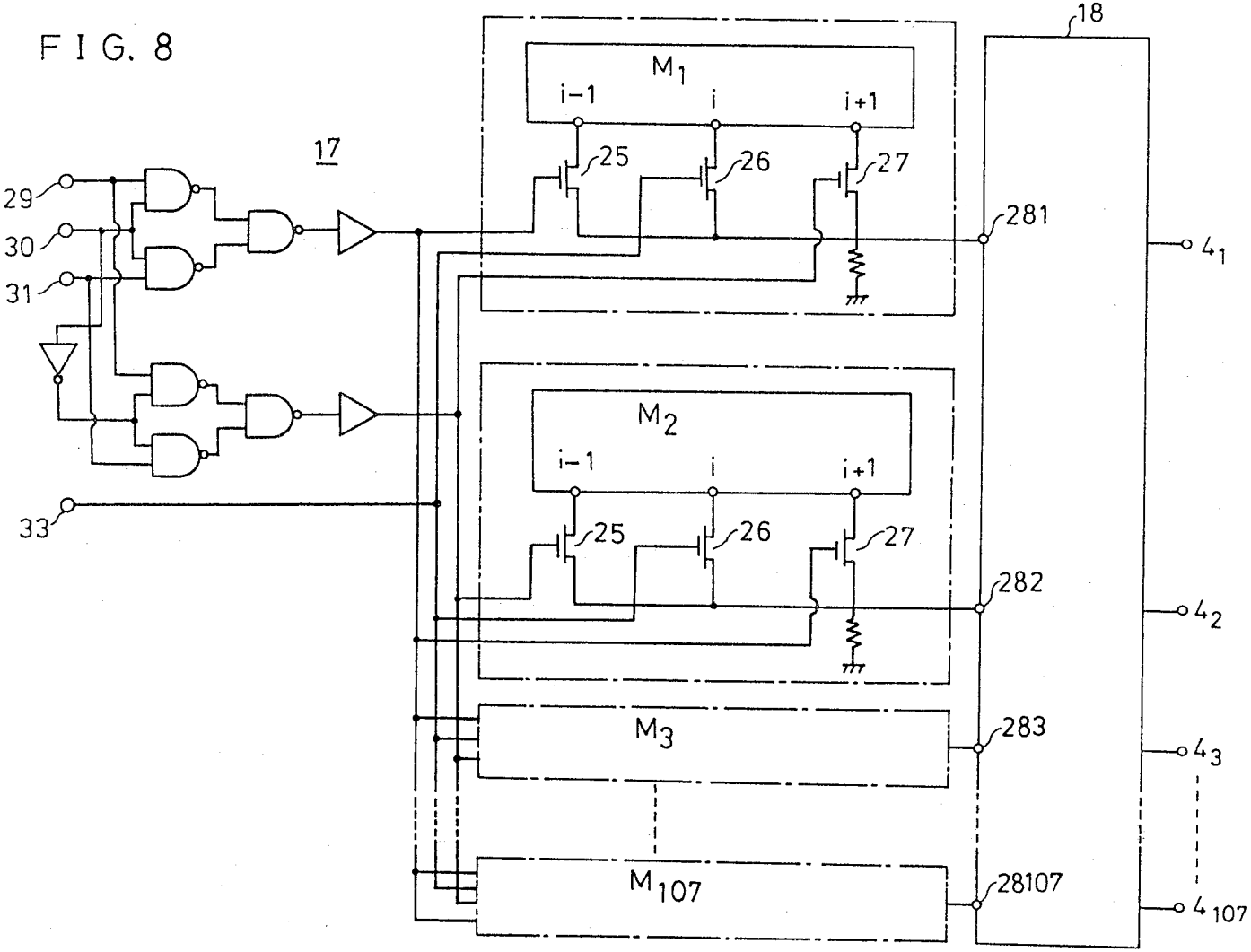
FIG. 8 is a circuit diagram of the multiplexer of the example circuit.
Figure 9:
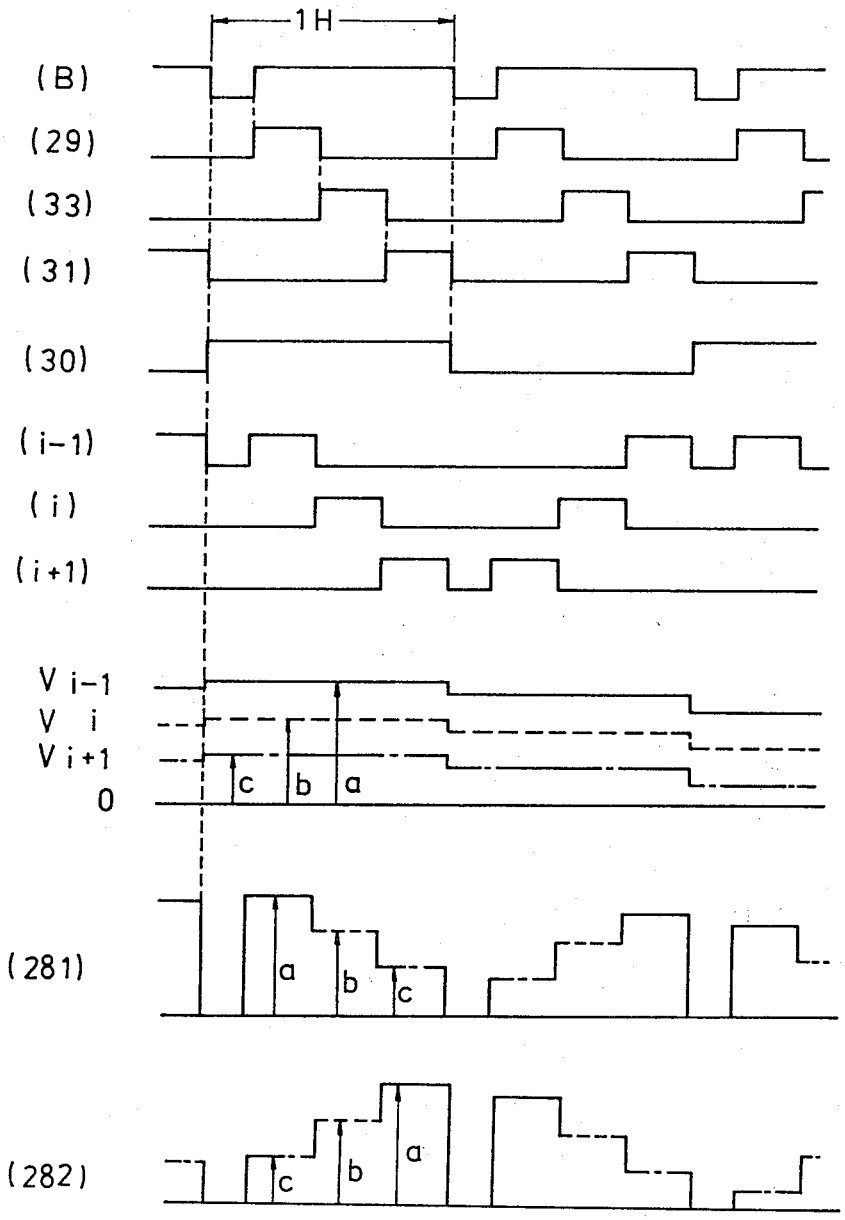
FIG. 9 is a waveform chart showing the waveforms of the signals of principal parts of the circuit of FIG. 8.
Figure 11:
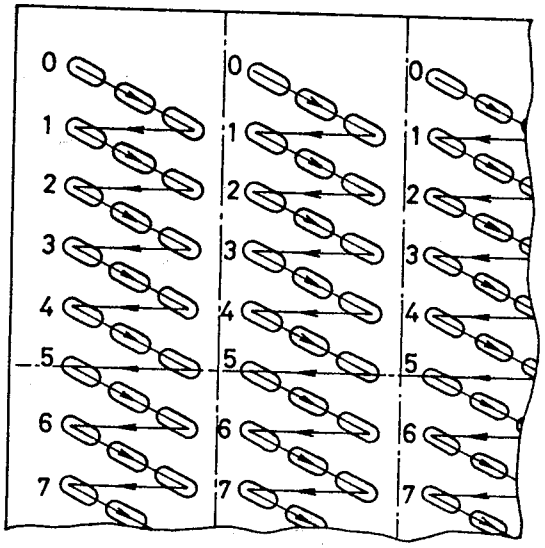
FIGS. 11(*a*), 11(*b*) and 11(*c*) are schematic views comparably illustrating the manners of scannings of the abovementioned various apparatuses.
Figure 11:
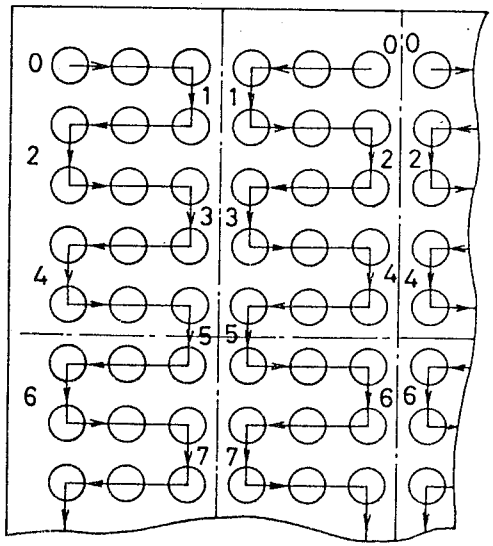
Figure 11:
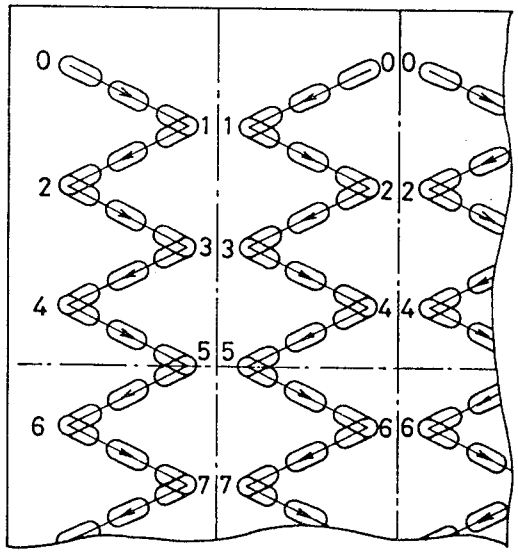

In the operation of the picture image display apparatus of multiple electron beam type having the abovementioned construction, scannings of beam spots on the phosphor screen 10 are made in the known line-at-a-time type scanning, wherein ordinary time-sequential image signal is converted into a plural number of parallel signals. For example, in the abovementioned case to display an image field raster having numbers of picture elements of 240 (in vertical direction) times 321 (in horizontal direction), with regard to the horizontal scanning of the beam spots the raster is divided into a plural number N of vertically oblong sections, wherein the horizontal scannings are carried out simultaneously in all of N sections. Then, each section has picture elements of n=(321/N) in the horizontal direction. For example, when the number N of the vertical sections is 107, the number n in horizontal scanning of picture element in each section is 3. For such example, 107 beam spots are produced from each linear thermionic cathode 1, and 107 control electrodes 4 are provided in order to control the 107 electron beam intensities. In the apparatus, the horizontal scanning is made by using suitable scanning wave, such as a signal wave which comprises a first scanning period of 1H wherein the voltage increases and a second scanning period of 1H wherein the voltage decreases, for example triangular wave as shown by FIG. 7(E) having a period of 2H or a step wave, etc. The triangular wave is applied across the pairs of the horizontal deflection electrodes 7, 7'. Since all the deflection spaces are defined by the deflection electrodes 7, 7' disposed and connected in the same order, all the N beam spots are simultaneously deflected to scan in the same direction in the first scanning period H, and in the next period H they are deflected to scan in the direction opposite to that of the scanning in the first scanning direction. Therefore, the scannings of the beam spots seen at an enlarged part of the phosphor screen is as shown in FIG. 11(*b*). The horizontal scanning period H is equal to the horizontal scanning period of the ordinary time sequential television signal. In order for attaining such line-at-a-time scanning, the ordinary time sequential image signal is preliminarily converted into the N parallel signals of the line-at-a-time type. As shown in FIG. 7 (B) and (E), the triangular wave to be applied to the horizontal deflection electrodes alternately increases and decreases its voltage, and each of the increasing period and the decreasing period has the horizontal scanning period H. That is, the scannings of the beam spots change its direction between odd number 1H periods and even number 1H period. Therefore, the contents of video signal to be applied to the control electrodes 4 must be preliminarily inversed for the leftwards scanning. FIG. 8 shows an example of circuit construction of the multiplexer circuit 17. And FIG. 9 is a waveform chart showing waveforms for use in the multiplexer circuit 17 of FIG. 8 to be operated under the condition of n=3 and m=5. In the waveform chart of FIG. 9, the waveform (B) is the horizontal synchronization signal of television signal like the waveform (B) of FIG. 7 and 1H represents one horizontal scanning period of the television signal. The signals (29), (30), (31) and (33) are signals to be impressed on the input terminals of the same number in FIG. 8. The waveforms (29), (33) and (31) are produced by known multivibrators or oscillators by using a signal (30) produced by dividing the horizontal synchronization signal of (B). The signals (i-1), (i) and (i+1) of FIG. 9 are signals to be impressed from the multiplexer circuit 17 to the read out terminals of the memories $M_1$, $M_2$ . . . . The waveforms $V_{i-1}$, $V_i$ and $V_{i+1}$ having amplitudes a, b and c show sample-hold levels of the video signal sampled by using sampling pulse having the frequency three times of the horizontal synchronization signal. Under a premise that in all the N-divided sections the video signal has the amplitudes a, b and c for three picture elements disposed from left to right of the section, the rearranged video signals of (281), (282) . . . of FIG. 9 are produced by the multiplexer circuit 17 and given as the control signals for the first, second, . . . control electrodes, respectively. At the drains of the MOS transistors 25, 26 and 27, the sample-held video signals of the amplitudes a, b and c appear, and accordingly the signals of the waveforms (281), (282) . . . are issued to the input terminals (281), (282) . . . of the composite amplifier 18, which impresses in parrallel amplified output signals on the control electrode $4_1$, $4_2$ . . . $4_{107}$.

The vertical scanning of the apparatus is made by dividing the raster into a plural number M sections from the top to the bottom, and at first in the first section, for example in the uppermost section, the plural number of beam spots, which simultaneously scan, also scan vertically (downwards). When the vertical scanning in the first section is over and all the beam spots reach the bottoms of the first horizontally oblong sections, then the forming of electron beams from the electrons of the first linear thermionic cathode ends and the forming of electron beams from the electrons from the second linear thermionic cathode starts by means of switching of cathode control signal applied to the cathodes 1, and the vertical scannings of the beam spots start in the second-from-the-top section and scan downwards in the same way as in the first-from-the-top section. The vertical scanning is made thus downwards to the bottom or M-th section by applying an ordinary saw-tooth wave having a period V of the vertical scanning period of the ordinary television signal. For the abovementioned example of the raster having the number of vertical picture element of 240, when the number M of the horizontally oblong section is 48, each of the section has the horizontal scanning lines of the number of n=(240/48)=5. That is to say in the case of the example apparatus using 48 linear thermionic cathodes, each cathode vertically scans to perform 5 lines of horizontal scannings.

As shown by FIG. 5(*a*) and FIG. 5(*b*), the deflection electrodes 6, 6' as well as 7, 7' are disposed to form such pairs therebetween that the electron beams in row passes through every gap formed by the neighboring deflection electrodes. This is contradistinctive to the apparatus shown by FIGS. 1(*a*) and 1(*b*), where every electron beam pass through the gaps of the electric field of the same direction deflecting every electron beams to the same directions. By the abovementioned configuration of FIG. 5(*c*), the neighboring electron beams pass electric field of opposite or symmetric directions. That is, the deflection electrodes are disposed with the uniform gaps and every gap is disposed below the electron beam passing apertures and openings, so that the electron beams pass every neighboring gaps which has opposite electric field to that of the neighboring gaps. Therefore, every neighboring gap has symmetric electric field to each other. Accordingly the electron beams e, e . . . in neighboring gaps of the deflection electrodes are deflected substantially symmetric each other as shown in FIG. 5(*b*). As a result of such symmetric scanning of neighboring sections, the scanning is made symmetric as shown, for example, by FIG. 11(*b*), etc. Therefore, for producing video signal for the scanning in the even numbered sections, i.e., 2nd, 4th . . . 106th sections, the control signal must be reversed with respect to its time order. In order to produce such reversed signal for the even order control electrode, in the multiplexer circuit 17 shown in FIG. 8, the connection of the gates of the MOS FETs 25 and 27 for the even order control electrodes are inversed from those of the other orders. Thereby, the control signal (282) of FIG. 9 which is a reversal of the time to that of the signal (281) of FIG. 9 is obtainable.

The vertical scanning of the apparatus of FIG. 5(*a*) and FIG. 5(*b*) is elucidated hereafter. Similar to the horizontal deflection electrodes 7, 7' the vertical deflection electrodes 6, 6' of FIG. 5(*a*) and FIG. 5(*b*) are constructed such that the electrodes 6, 6' are disposed with uniform gap is every gaps are disposed below the electron beam passing apertures and openings, so that every neighboring gap have symmetric electric field to each other. Then, the vertical deflection voltage having the waveform (F) of FIG. 7 is impressed across the vertical deflection electrode 6 and 6'. Then, when the first (the top) linear thermionic cathode is impressed by a negative pulse signal, electron beams from the first cathode are taken out through the apertures and openings 3*a*, 4*a* and 5*a* and the electron beams pass through the first (the top) gap between the vertical deflection electrodes 6 and 6'. When the electrode 6 is positive against the electrode 6' at first and changes gradually to negative by the impression of the vertical deflection signal voltage of the triangular waveform of FIG. 7(*f*), then the electron beam spots runs downwards by the vertical scanning from each top of the first vertical sections to the bottoms thereof also scanning horizontally by the triangular wave. Accordingly the beam spots run down in zigzag course as shown by FIG. 11(*b*). When the scanning beam spots reach the bottom positions indicated by numeral (5) of the first vertically divided sections in FIG. 11(*b*), the electron beams from the first linear cathode are extinguished in compliance with control signal from the circuit 24, and at the same time, electrons from the second linear cathode starts to form electron beams. And at that time in the second vertically divided sections, the beam spots produced by the electron beam from the second linear cathode just comes to the top positions of the second sections which are the same position (5) of FIG. 11(*b*), by means of the deflection electric field applied to the gap between the electrode 6' and 6. That is, in the apparatus of FIG. 5(*a*), the relation between the vertical electrodes 6 and 6' and the electron beams is similar to that for the horizontal electrode 7, 7', and therefore, the deflections of the electron beams in the vertical directions are symmetrical between the vertically neighboring sections. Accordingly, when a beam spots scans and reach the bottom of a section, a beam spot of the lower section also reach the top position thereof. Therefore, by relaying the operation of the electron beam formings sequentially downwards at the time when the beam spot in a vertical section reaches its bottom, the overall appearances of the beam spots become such that as if the beam spots continuously scan down passing the vertical section boundaries. And thus, the beam spots scan downwards in the second divided sections and thereafter. In the same way the beam spots from the subsequent cathodes follow the scanning in their own vertically divided sections.

In the abovementioned example of FIG. 5(*a*) and FIG. 5(*b*), the scanning can be satisfactorily made by using various kinds of scanning waves, for example, saw-tooth wave, or the wave which comprises the first scanning period of 1 H wherein the voltage increases and the second scanning period of 1 H wherein the voltage decreases, such as triangular wave or step wave, etc. And furthermore, number of deflection electrodes can be halved. Therefore, the manufacture of the apparatus as well as stability and deflection accuracy, and hence, quality of the reproduced image is considerably improved in comparison with the case of the prior stage proposal of FIGS. 1(*a*) and 1(*b*).

In the abovementioned examples of the present invention, the numbers n and m are selected n=3 and m=5. But these numbers can be selected in other combinations, for example n=6 and m=15 and so on.

Figure 10:
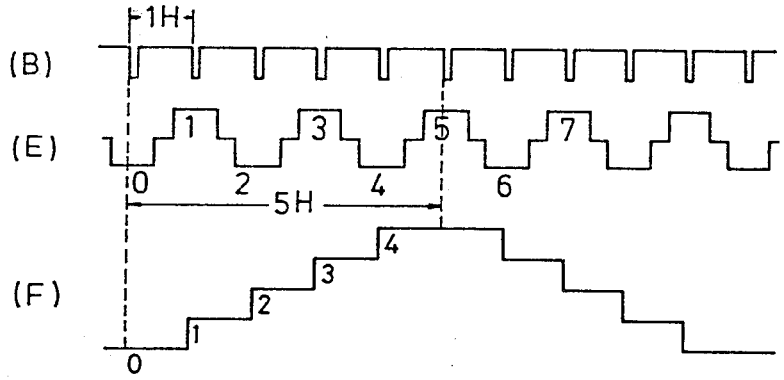
FIG. 10 is a waveform chart showing the waveforms of the signals of principal parts of FIG. 6.

By using the present apparatus, the spot can be scanned in other way. FIG. 10 shows waveforms for use in such a modified example wherein said horizontal deflection signal generator 20' and said vertical deflection signal generator 22' are formed to issue deflection signals of step waves (E) and (F) of FIG. 10, respectively. Waveform (B) of FIG. 10 is the horizontal synchronization signal. By use of the horizontal deflection signal and vertical deflection signal having such step waveform signals, the scannings of the beam spots are as shown in FIG. 11(*c*), that is, the spots move stepwise stopping for necessary short time on ideal scanning locus formed with horizontal and vertical lines. Accordingly, the spots are formed with clear dot shape and move very accurately without making overlapping of spots like dot-matrix type panel display apparatus. Therefore, when the dots on the phosphor screen are RGB phosphor dots, a high color saturation is attainable by the accurate scanning.

In the application of the deflection signal across the deflection electrodes, both the first way of fixing potentials of a first group electrodes 6 or 7 to a predetermined constant potential and impressing the signals on the second group of them 6' or 7', or the second way of impressing the signal across both electrode 6 and 6' or 7 and 7' retaining the central (averaged) potential thereof constant can be usable.

Figure 1:
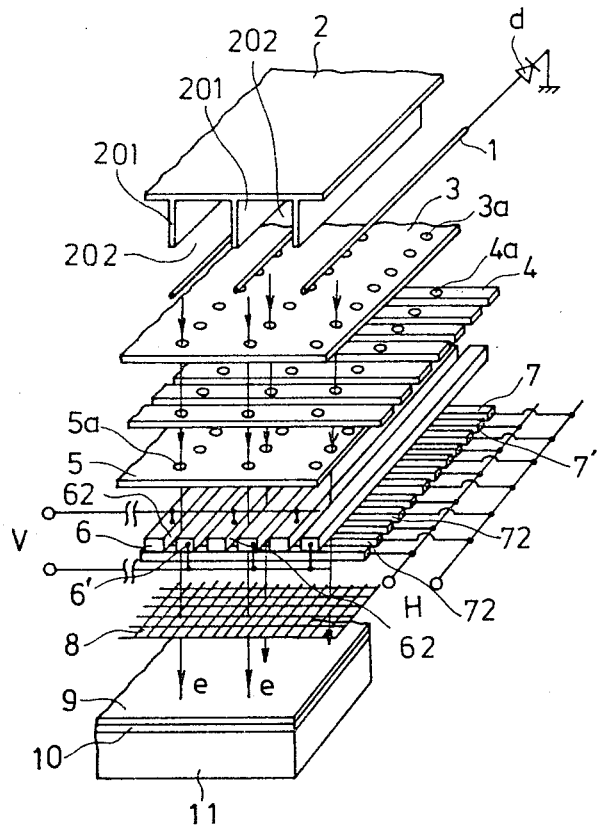
FIG. 1(*a*) is an exploded perspective view showing the principal part of a display apparatus which has been described in the Japanese Patent Application Sho 53-106788 (published as unexamined patent gazette Sho 55-33734) and also described in the specification of the U.S. Pat. No. 4,227,117.
Figure 1:
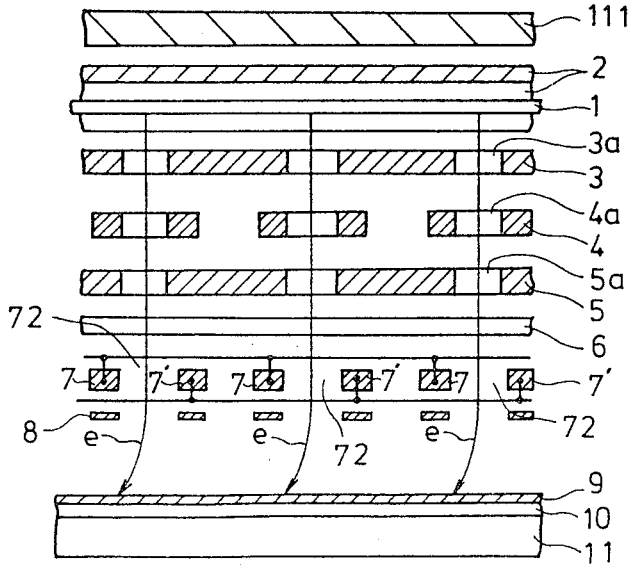
Figure 2:
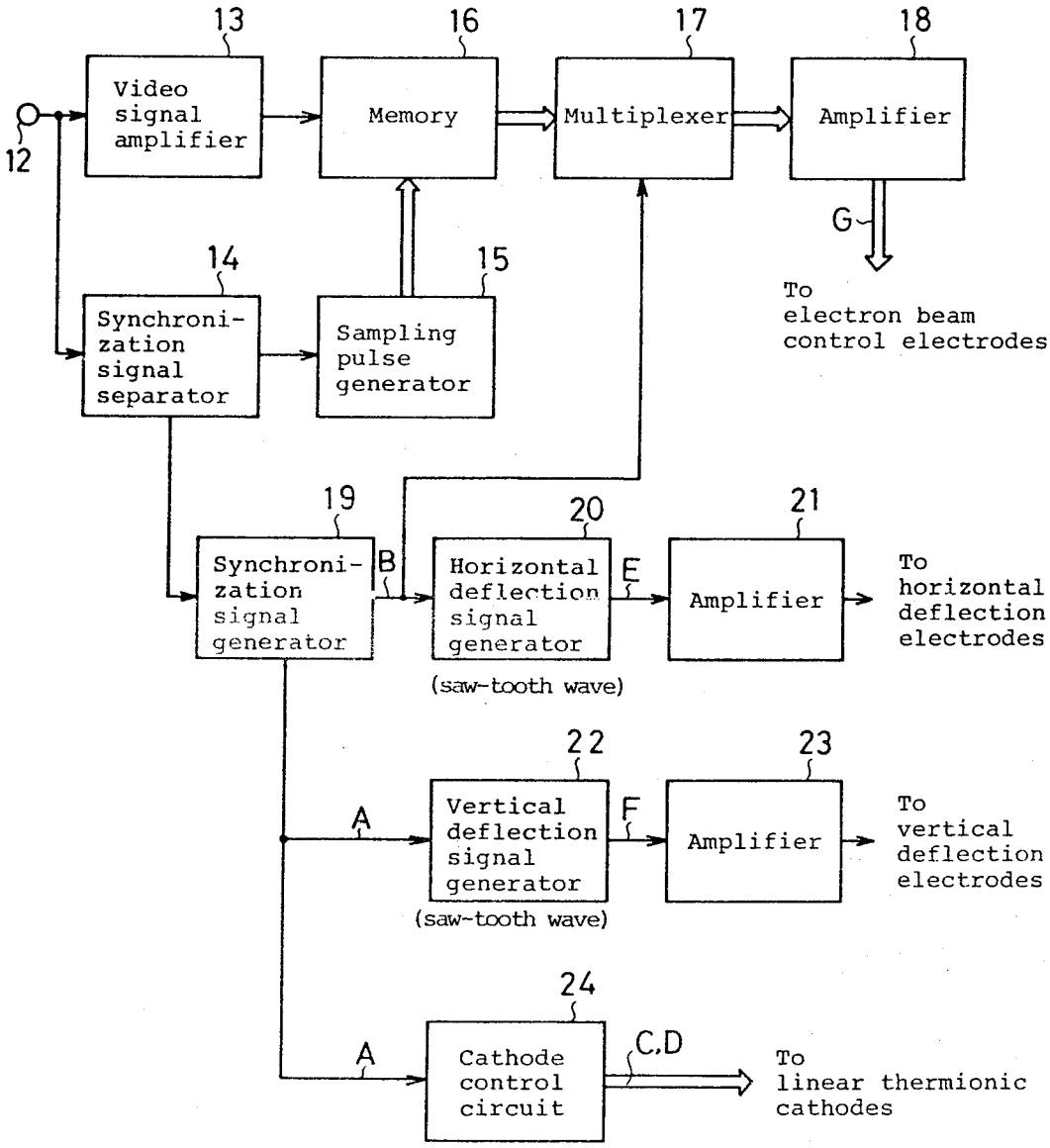
FIG. 2 is a circuit diagram of the picture image display apparatus shown in FIGS. 1(*a*) and 1(*b*).
Figure 3:
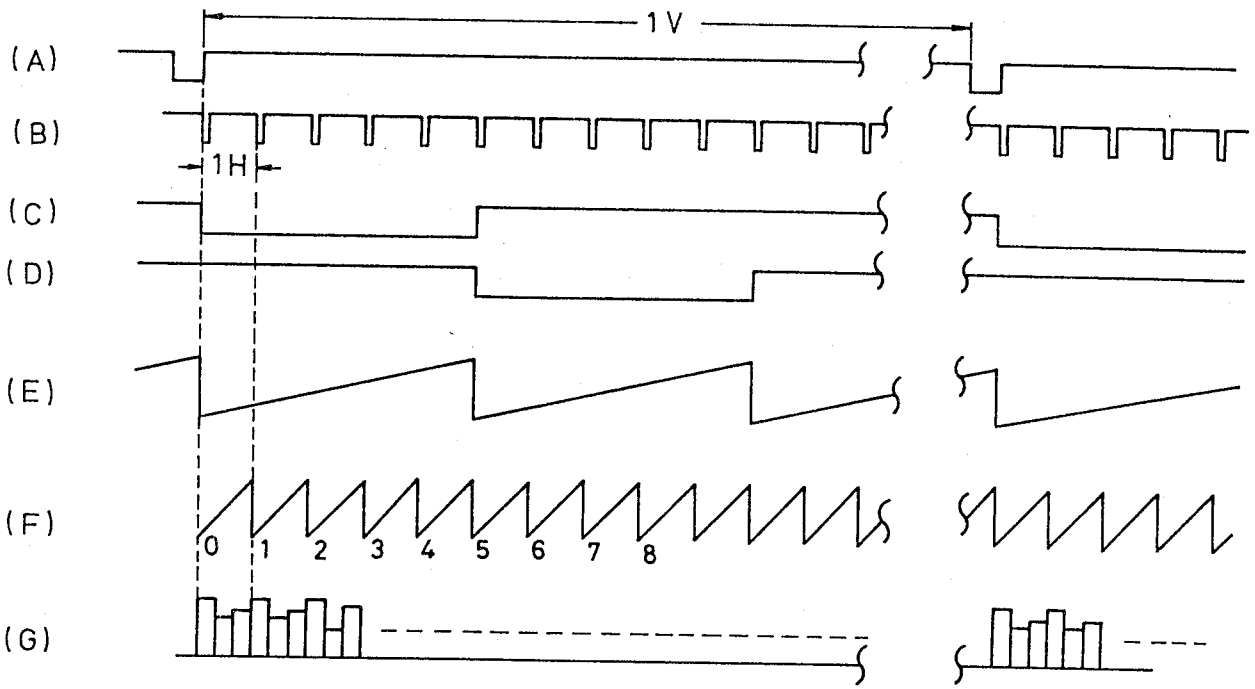
FIG. 3 is a waveform chart showing waveforms of signals at various parts of the circuit of FIG. 2.
Figure 4:
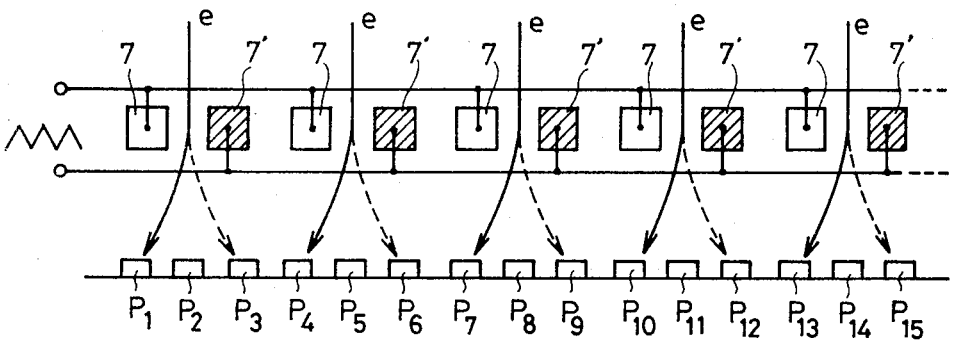
FIG. 4(*a*) and FIG. 4(*b*) are sectional views comparatively showing deflecting parts of the fine deflection electrodes of the apparatus of FIG. 1(*a*) and wide deflection electrodes of a modified case.
Figure 4:
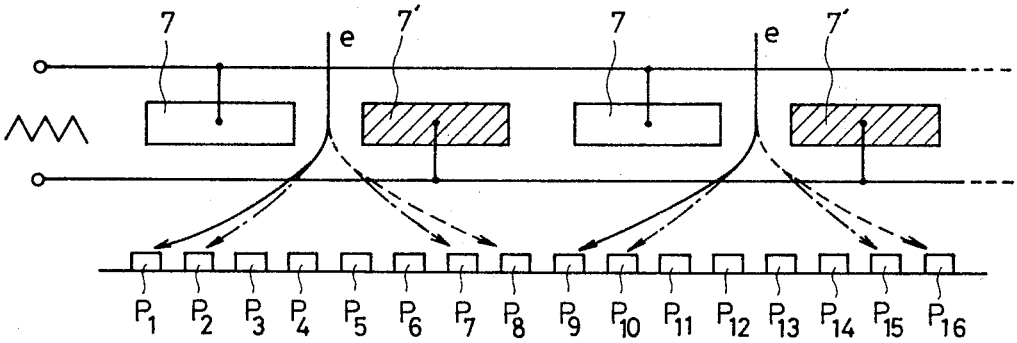

As has been elucidated in detail, the picture image display device in accordance with the present invention has smaller number of deflection electrodes in comparison with the previously proposed apparatus of FIGS. 1(*a*) and 1(*b*), and still has easy and accurate deflections of electron beams, since the number of the deflection electrode can be decreased, the width of the horizontal electrode 7, 7', for example, can be increased to 0.97 mm, and accordingly, undesirable bending or sag of the deflection electrode or changes of deflection gaps due to vibration, or heat, or due to distortion of frit glass per se can be remarkably reduced. Especially, loss of registration between the deflection electrodes 7, 7' and other components such as phosphor dots 10 or electron beam shaping apertures 5*a* between the central part and peripheral parts of the picture screen hardly occurs in the apparatus embodying the present invention.

What is claimed is:

1. A picture image display apparatus comprising:
   - a flat type vacuum enclosure having a transparent face panel,
   - an electron beam emitter which emits a predetermined number of electron beams disposed in a row in selected positions,
   - a row of control electrodes to control intensities of said electron beams,
   - a row of parallel deflection electrodes, every other one of them being first electrodes commonly connected to each other, the other ones of them being second electrodes commonly connected to each other,
   - a phosphor screen formed on the inner face of said face panel, and
   - an anode of thin metal film formed on the surface of said phosphor screen, wherein the apparatus is characterized in that
   - every one of said first electrodes and a neighboring one of said second electrodes form a deflection gap, neighboring one of said gaps have electric fields of opposite directions relative to each other, and said gaps are disposed in a manner such that said electron beams simultaneously pass through every said deflection gap.

2. A picture image display apparatus in accordance with claim 1, wherein said electron beam emitter comprises a plural number of linear thermionic cathodes.

3. A picture image display apparatus in accordance with claim 2 wherein
   - said electron beam emitter comprises an extractor electrode disposed under said linear thermionic cathodes and having apertures to pass electron beams therethrough,
   - said control electrodes being disposed under said apertures and every said control electrode having electron beam passing openings disposed under said apertures, and
   - every gaps formed between said deflection electrodes being disposed under said electron beam passing openings.

4. A picture image display apparatus in accordance with claim 1, wherein said commonly connected first electrodes are connected to a first terminal and said commonly connected second electrodes are connected to a second terminal for receiving signals impressed across said first and second terminals.

* * * * *